US010849384B2

(12) United States Patent
Johnson et al.

(10) Patent No.: US 10,849,384 B2
(45) Date of Patent: Dec. 1, 2020

(54) FACEMASK AND HELMET WITH FACEMASK

(71) Applicants: Kyle Johnson, Albuquerque, NM (US); Mark F. Horstemeyer, Starkville, MS (US); Souma Chowdhury, Buffalo, NY (US); Yuxiong Mao, Johns Creek, GA (US)

(72) Inventors: Kyle Johnson, Albuquerque, NM (US); Mark F. Horstemeyer, Starkville, MS (US); Souma Chowdhury, Buffalo, NY (US); Yuxiong Mao, Johns Creek, GA (US)

(73) Assignee: Mississippi State University, Mississippi State, MS (US)

( * ) Notice: Subject to any disclaimer, the term of this patent is extended or adjusted under 35 U.S.C. 154(b) by 249 days.

(21) Appl. No.: 15/424,693

(22) Filed: Feb. 3, 2017

(65) Prior Publication Data

US 2017/0231313 A1 Aug. 17, 2017

Related U.S. Application Data

(60) Provisional application No. 62/290,625, filed on Feb. 3, 2016.

(51) Int. Cl.
*A42B 3/20* (2006.01)
*A42B 3/12* (2006.01)

(52) U.S. Cl.
CPC ..... *A42B 3/20* (2013.01); *A42B 3/127* (2013.01)

(58) Field of Classification Search
CPC ..... A42B 3/20; A42B 3/127; A42B 3/18
(Continued)

(56) References Cited

U.S. PATENT DOCUMENTS 2,785,405 A * 3/1957 Snyder ..... A42B 3/20 2/9
3,889,296 A * 6/1975 Martin ..... A42B 3/20 2/9

(Continued)

*Primary Examiner* — Katharine Gracz
(74) *Attorney, Agent, or Firm* — Lawrence Arthur Schemmel

(57) ABSTRACT

A helmet includes a housing sized for use on a human head and having an opening designed to expose a face associated with the human head and a facemask attached to the housing and situated over the opening to cover the face. The facemask has a slightly curved front portion, a slightly curved right side portion, and a slightly curved left side portion. The facemask has a plurality of substantially vertically oriented bars having different widths. The vertically oriented bars include a first type having a first width, a second type having a second width that is larger than the first width, and a third type having a third width that is larger than the first and second widths. The left and right side portions of the facemask include a first type bar and a second type bar, where the second type bar is situated nearer to the housing than the first type bar. The front portion of the facemask includes four first type bars, for example, two on a left side of the front portion and two on a right side of the front portion. A single third type bar is situated in a right side transitional region between the front portion and the right side portion of the facemask and in a left side transitional region between the front portion and the left side portion.

6 Claims, 7 Drawing Sheets

(58) Field of Classification Search
USPC ..... D29/111
See application file for complete search history.

(56) References Cited

U.S. PATENT DOCUMENTS 3,897,598 A * 8/1975 Bednarczuk ..... A42B 3/20 2/9
4,031,564 A * 6/1977 Wood ..... A42B 3/20 2/9
4,933,993 A * 6/1990 McClelland ..... A42B 3/20 2/424
4,947,490 A * 8/1990 Hayden ..... A42B 3/20 2/424
4,999,856 A * 3/1991 Duvall ..... A42B 3/20 2/10
5,249,347 A * 10/1993 Martinitz ..... A42B 3/20 2/424
D444,920 S * 7/2001 Hicks, Jr. ..... D29/111
6,938,272 B1 * 9/2005 Brown ..... A42B 3/20 2/424
8,695,122 B2 * 4/2014 Deboer ..... A42B 3/20 2/424
2003/0070201 A1 * 4/2003 McClelland ..... A42B 3/20 2/9
2004/0049825 A1 * 3/2004 DeHaan ..... A42B 3/20 2/6.7
2007/0050896 A1 * 3/2007 Stevens ..... A42B 3/20 2/427
2007/0186324 A1 * 8/2007 Sheldon ..... A42B 3/20 2/9
2007/0266471 A1 * 11/2007 Lin ..... A42B 3/20 2/9
2008/0000001 A1 * 1/2008 Benvenuto ..... A42B 3/20 2/15
2008/0127400 A1 * 6/2008 Dupuis ..... A42B 3/105 2/424
2008/0189821 A1 * 8/2008 Anderson ..... A42B 3/18 2/9
2009/0083891 A1 * 4/2009 Cote ..... A42B 3/20 2/9
2011/0138520 A1 * 6/2011 Deboer ..... A42B 3/20 2/425
2012/0137413 A1 * 6/2012 Deboer ..... A42B 3/20 2/424
2016/0128415 A1 * 5/2016 Tubbs ..... A42B 3/205 2/424

* cited by examiner

FACEMASK AND HELMET WITH FACEMASK

CROSS-REFERENCE TO RELATED APPLICATION

This application claims priority to provisional U.S. Application No. 62/290,625, filed Feb. 3, 2016, which is incorporated herein by reference in its entirety.

FIELD OF INVENTION

This application generally relates to helmets to be worn by a human and to protect the human head from injury.

BACKGROUND

Current research data show that, even with recent advances in sports helmets, approximately 1.6 to 3.8 million sports-related traumatic brain injuries (TBI's) occur each year. Although no universally-accepted definition of concussion exists, a consensus has arisen that a concussion is a complex pathophysiological process affecting the brain, induced by traumatic biomechanical forces. Recently, brain injuries suffered by National Football League (NFL) players have gained a great deal of attention. In 2005, a study found that NFL players exposed to multiple concussions suffered clinical depression at three times the rate of the rest of the population, and other studies showed that NFL players with concussion history are five times more likely to suffer cognitive impairment. A recent National Collegiate Athletic Association (NCAA) study demonstrated that players with a history of previous concussions were more likely to have future concussive injuries than those with no history. Another study showed that more than 5% of high school and collegiate players sustained a concussion in a season. Similar stories have surfaced frequently during the past several years in which NFL players were diagnosed with Chronic Traumatic Encephalopathy (CTE), which is a buildup of tau protein in the brain leading to memory loss, behavior and personality change, confusion, dementia, and depression that has sometimes led to suicide. One of the most recent examples of the gravity of the TBI problem in professional football comes from a court filing involving the NFL. In 2014, lawyers for the NFL stated that approximately twenty-eight percent of former players are expected to suffer from some type of neurological problem.

Despite all of the studies showing the dangers of concussions, we have only seen very incremental improvements of the football helmet design and fabrication during the past few decades and scarcely any changes to facemasks. When attempting to improve helmet protection, facemasks are typically overlooked and the focus is usually directed to the foam liner. However, a recent study of 182 severe NFL impacts found that 29% involved the facemask. That study also found that the concussions occurred at the lowest peak head acceleration in facemask impacts at 78±18 g's, compared to 107-117 g's for shell impacts. The study also demonstrated that removal of two facemask bars caused a reduction in head acceleration of approximately 30%, which shows that helmets can be made safer by optimizing the facemask.

Very little research exists concerning computational design optimization of any type of helmet. One study applied manual modifications to a motorcycle helmet based on modal analysis in order to reduce stress in the brain. Another study performed single objective optimization on a motorcycle helmet to determine foam density, foam thickness, and shell thickness in order to minimize the peak acceleration, but this did not include the human head.

SUMMARY OF THE INVENTION

The present invention and disclosure provides various embodiments of a facemask and sports facemask that can be used with sporting safety helmets to protect the human brain. The research that resulted in the invention is the first of its kind to perform multi-objective design optimization on helmet, and specifically a football helmet, and is also unique to most design optimization methods in that brain injury metrics (tensile pressure and shear strain) are used as objective functions.

One embodiment, among others, is a helmet that comprises a housing sized for use on a human head and having an opening designed to expose a face associated with the human head and a facemask attached to the housing and situated over the opening to cover the face. The facemask has a front portion, a right side portion, a left side portion, and a plurality of vertical bars having different widths.

Another embodiment, among others, is a facemask that can be installed on a helmet. In this regard, the facemask comprises a slightly curved front portion, a slightly curved right side portion, and a slightly curved left side portion. The facemask has a plurality of substantially vertically oriented bars having different widths. The vertically oriented bars include a first type having a first width, a second type having a second width that is larger than the first width, and a third type having a third width that is larger than the first and second widths. The left and right side portions of the facemask include a first type bar and a second type bar, where the second type bar is situated nearer to the housing than the first type bar. The front portion of the facemask includes four first type bars, two on a left side of the front portion and two on a right side of the front portion. A single third type bar is situated in a right side transitional region between the front portion and the right side portion of the facemask and in a left side transitional region between the front portion and the left side portion.

Yet another embodiment, among others, is a helmet that comprises a housing sized for use on a human head and having an opening designed to expose a face associated with the human head and the facemask described in the previous paragraph attached to the housing and situated over the opening to cover the face.

Other embodiments, apparatus, devices, features, characteristics, and methods of the present invention will become more apparent in the Detailed Description of Invention section and accompanying drawings and claims, all of which form a part of this specification.

BRIEF DESCRIPTION OF THE DRAWINGS

The various embodiments and features of the invention are depicted in the following drawings. The components in the drawings are not necessarily to scale, emphasis instead being placed upon clearly illustrating the principles of the embodiments of the present disclosure. Moreover, in the drawings, like reference numerals designate corresponding parts throughout the several views.

DETAILED DESCRIPTION OF THE INVENTION

The present invention provides various embodiments of a sports facemask that can be used with sporting safety helmets to protect the human brain. A multi-objective simulation based design optimization was employed using the mechanical damage to the brain. This design optimization is described in detail in the following publication, which is incorporated herein by reference in its entirety: Johnson, K. L., S. Chowdhury, W. B. Lawrimore, Y. Mao, A. Mehmani, R. Prabhu, G. A. Rush, and M. F. Horstemeyer, "Constrained topological optimization of a football helmet facemask based on brain response", *Materials & Design* 111, 108-118, 2016.

In the design optimization, front impacts and side impacts were used as the loading conditions. Also, in the modelling, the center of gravity was situated in the center of the helmet 10. The design process included first creating a Latin Hypercube Design of Experiments, which is well-known in the art, to determine the finite element simulations that were needed. Other well-known layouts could be used to set up the design as well, such as any Analysis of Variance (ANOVA) method comprising a broad range of methods. Then, different original designs were employed for the 10 simulations. The brain damage from the 10 simulations were then used to train a metamodel that spanned all of the Latin Hypercube space. A multi-objective design optimization scheme was then used on the metamodel response surface and one solution was determined. A finite element simulation was then conducted with the optimal facemask solution that reduced the brain damage from the two different impact locations. The results verified the optimization result.

Figure 6:
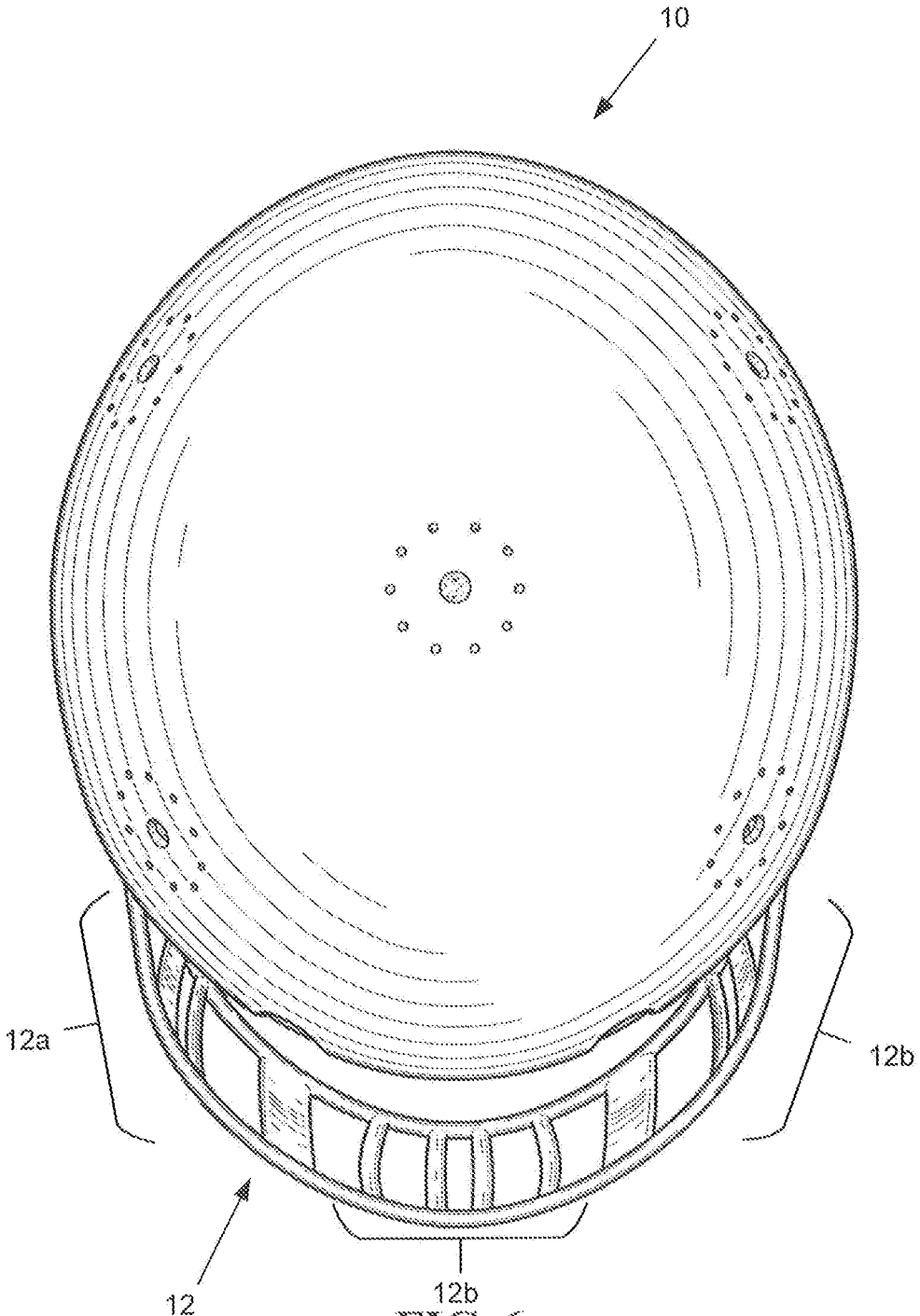
FIG. 6 is a top view thereof.
Figure 7:
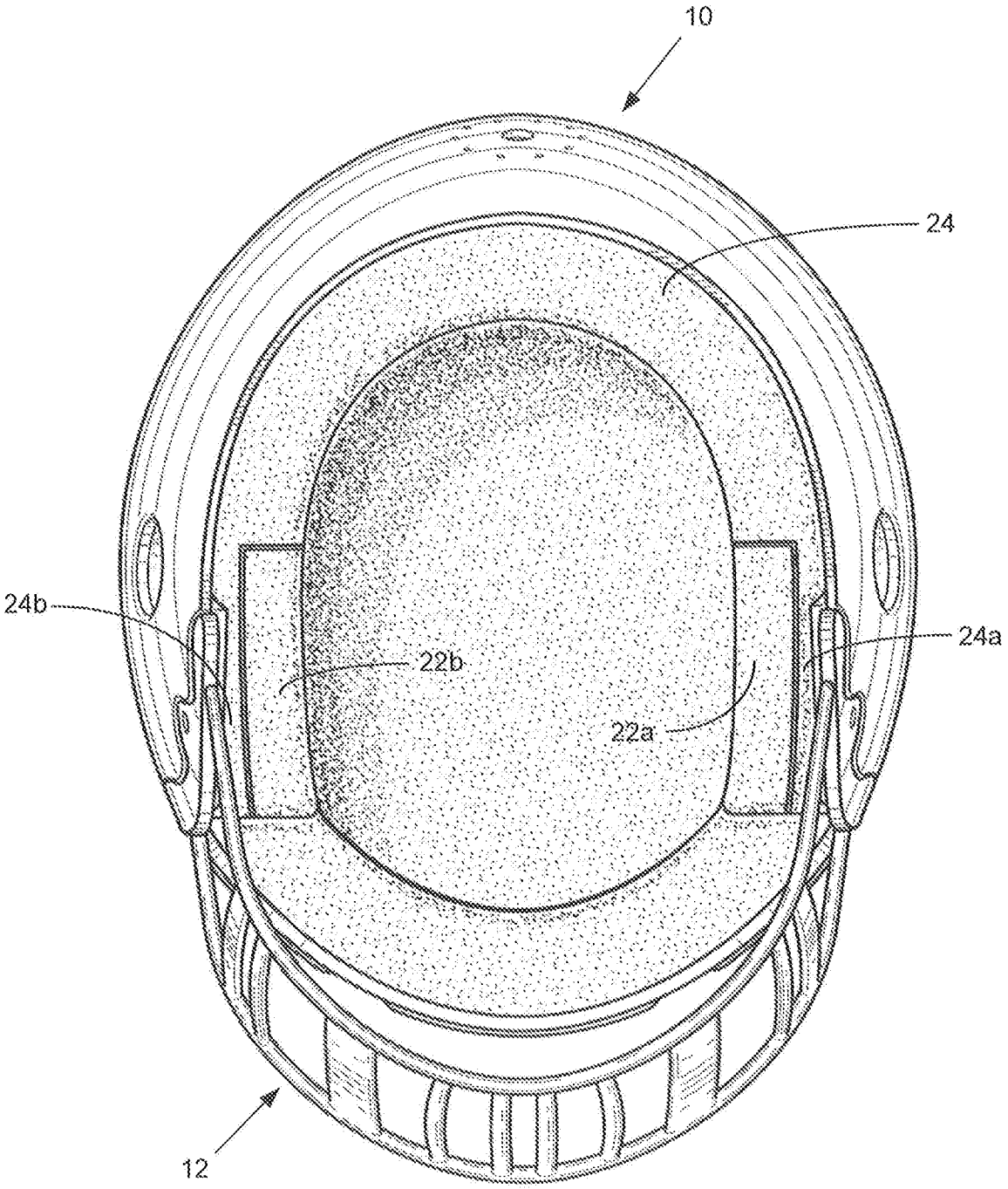
FIG. 7 is a bottom view thereof.

The preferred embodiment of the helmet 10 with facemask 12 is shown in FIGS. 1-7. This embodiment is specifically designed for American football. As is shown, the facemask 12 is attached to a facemask mounting frame 14, which is mounted in a recess in the helmet shell 15 (a housing) so that there is a generally smooth, continuous outer surface transitioning between the facemask mounting frame 14 and the helmet shell 15. The helmet shell 15 is sized and shaped to fit on a human head. As illustrated in FIG. 6, the facemask 12 has a slightly curved right side portion 12*a*, a slightly curved front portion 12*b*, and a slightly curved left side portion 12*c*.

Based upon the modeling, the optimal design of the facemask 12 comprises 10 vertically oriented bars 16*a*-16*j* and no horizontal bars aside from the extreme top and bottom bars 18 and 19, respectively, to which the vertically oriented bars 16 attach. As shown in FIGS. 4-7, the design of the facemask 12, which is optimized for tensile pressure, includes a number of approximately 6 mm wide bars 16 with bar 16*b* on the right side portion 12*a*, bars 16*d*-16*g* on the front side portion 12*b*, and bar 16*i* on the left side portion 12*c*. The facemask 12 also includes one approximately 12 mm wide bar 16*a* and 16*j* on each of the right and left side portions 12*a* and 12*c*, respectively. The facemask 12 further includes one approximately 18 mm wide bar 16*c* and 16*h* at respective transitional regions between the front side portion 12*b* and right side portion 12*a* as well as front side portion 12*b* and left side portion 12*c*, respectively. The smaller width bars 16*b*, 16*d*-16*g*, and 16*i* are preferably about 6 mm wide, but could be wider or less wide, depending on the material used. This computer model used titanium as the material, but other materials may be used including but not limited to, steel, aluminum, etc. Also, the bars 16*a*-16*j* preferably have rounded edges in order to reduce stress concentrations. The depth dimension in a direction between an outside and inside of the facemask of each of the first, second, and third type vertical bars is approximately 6 mm.

An example of the preferred embodiment of the facemask 12, based upon the modeling, the specific dimensions of the bars 16, 18, and 19, as well as the placement and spacing, are as follows.

In terms of size, the bars 18 and 19 are 6 units of measure (e.g., mm) in width. The bars 16*a* and 16*i* are 12 units in width, and 70 units in vertical height. The bars 16*b* and 16*i* are 6 units in width, and 74 units in vertical height. The bars 16*c* and 16*h* are 18 units in width, and 95 units in vertical height. The bars 16*d* and 16*g* are 6 units in width, and 92 units in vertical height. The bars 16*e* and 16*f* are 6 units in width, and 93 units in vertical height.

In terms of spacing, bars 16*a* and 16*i* are situated at the nearest side at an approximate distance of 23 units from the facemask frame 14 at the bottom and at an approximate distance of 22 units from the facemask frame 14 at the top. Moreover, the approximate distances between the bars 16 (outside edge to outside edge) is as follows. The distance between bars 16*a* and 16*b* is in the range of 9.52 to 14.20 units. The distance between bars 16*b* and 16*c* is in the range of 37.85 to 39.90 units. The distance between bars 16*c* and 16*d* is in the range of 19.72 to 23.30 units. The distance between bars 16*d* and 16*e* is in the range of 12.31 to 14.89 units. The distance between bars 16*e* and 16*f* is in the range of 7.47 to 8.95 units. The distance between bars 16*f* and 16*g* is in the range of 12.31 to 14.89 units. The distance between bars 16*g* and 16*h* is in the range of 19.72 to 23.30 units. The distance between bars 16*h* and 16*i* is in the range of 37.85 to 39.90 units. Finally, the distance between bars 16*i* and 16*j* is in the range of 9.52 to 14.20 units.

Note that there are other possible embodiments. Several optimal designs resulted in at least one location where two approximately 6 mm bars 16 were placed adjacent to each other, creating in effect a wider approximately 12 mm bar 16.

Another possible embodiment could consist of the facemask 12, wherein the facemask 12 has a plurality of substantially vertically oriented bars having different widths. The vertically oriented bars include a first type having a first width, a second type having a second width that is larger than the first width, and a third type having a third width that is larger than the first and second widths. The left and right side portions of the facemask include a first type bar and a second type bar, where the first type bar is situated nearer to the housing than the second type bar. The front portion of the facemask includes four first type bars, for example, two on a left side of the front portion and two on a right side of the front portion. A single third type bar is situated in a right side transitional region between the front portion and the right side portion of the facemask and in a left side transitional region between the front portion and the left side portion.

Another possible embodiment could consist of the facemask 12, wherein the facemask 12 has a plurality of substantially vertically oriented bars having different widths. The vertically oriented bars include a first type having a first width, and a second type having a second width that is larger than the first width. The left and right side portions of the facemask include a first type bar and a second type bar, where the second type bar is situated nearer to the housing than the first type bar. The front portion of the facemask includes first type bars, second type bars, or a combination of both.

Another possible embodiment could consist of the facemask 12, wherein the facemask 12 has a plurality of substantially vertically oriented bars having a single width. The vertically oriented bars include a first type having a first width, and a second type having a second width that is larger than the first width. The left and right side portions of the facemask include a number of first type bars. The front portion of the facemask includes four first type bars, for example. A number of first type bars are situated in close proximity to each other in a right side transitional region between the front portion and the right side portion of the facemask and in a left side transitional region between the front portion and the left side portion.

In another embodiment, and concerning the plurality of substantially vertically oriented bars, the first type vertical bars of the facemask 12 have a substantially circular cross sectional area throughout their substantial lengths and the second type vertical bars and third type vertical bars have a substantially rectangular cross section or cross sectional area throughout their substantial lengths.

Figure 1:
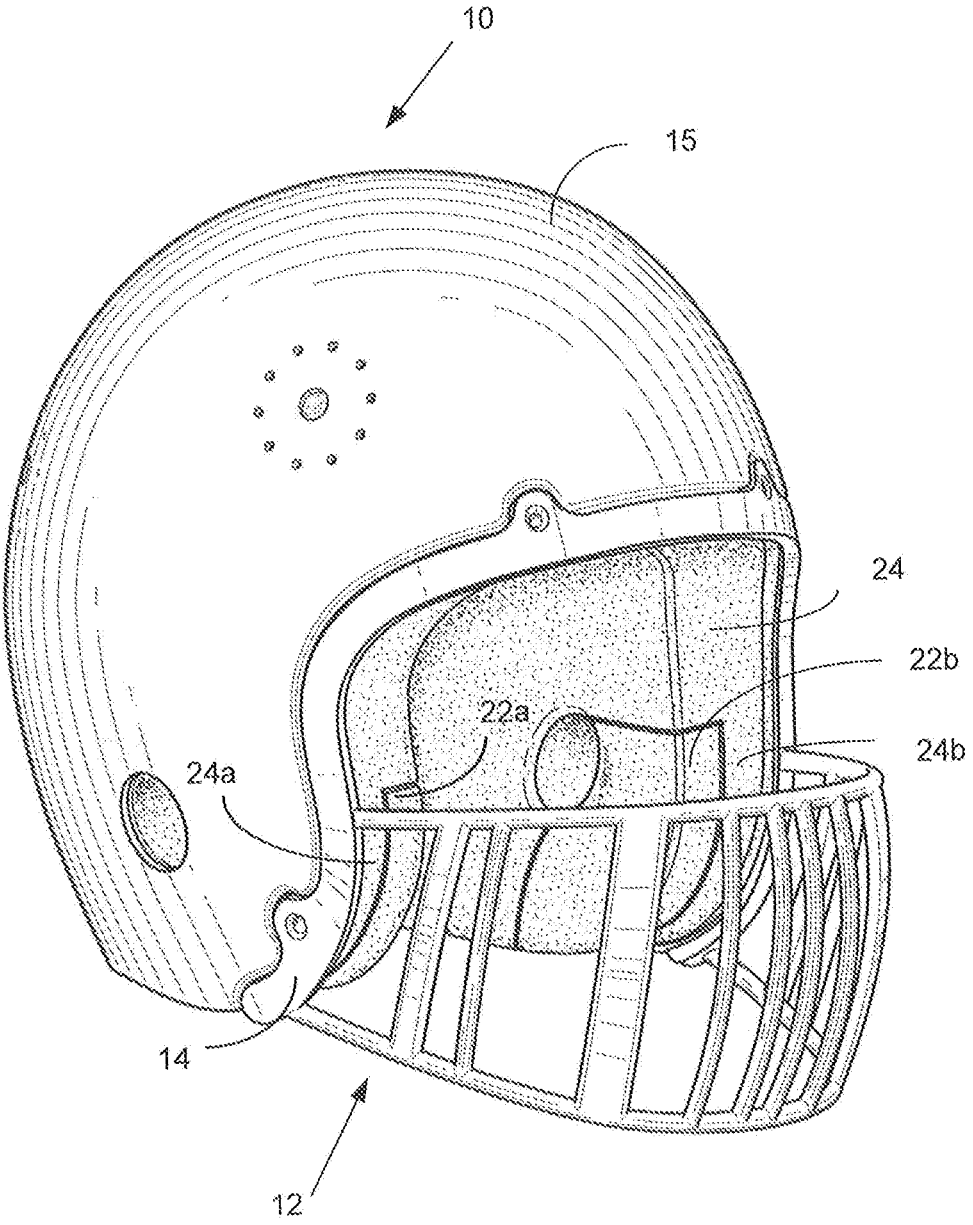
FIG. 1 is a perspective view showing an embodiment of a helmet with facemask, among others, of the present disclosure.
Figure 2:
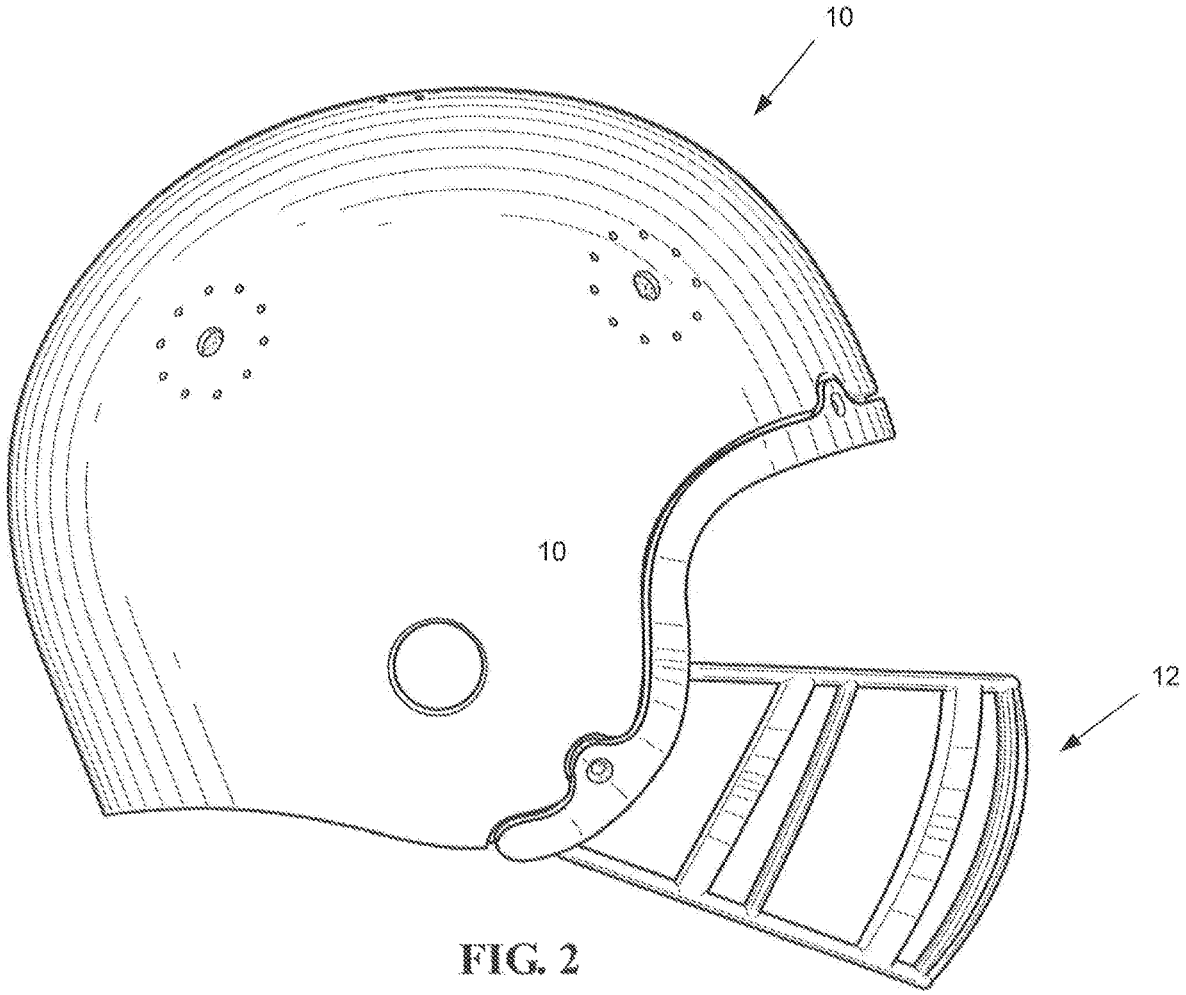
FIG. 2 is a right side view thereof.
Figure 3:
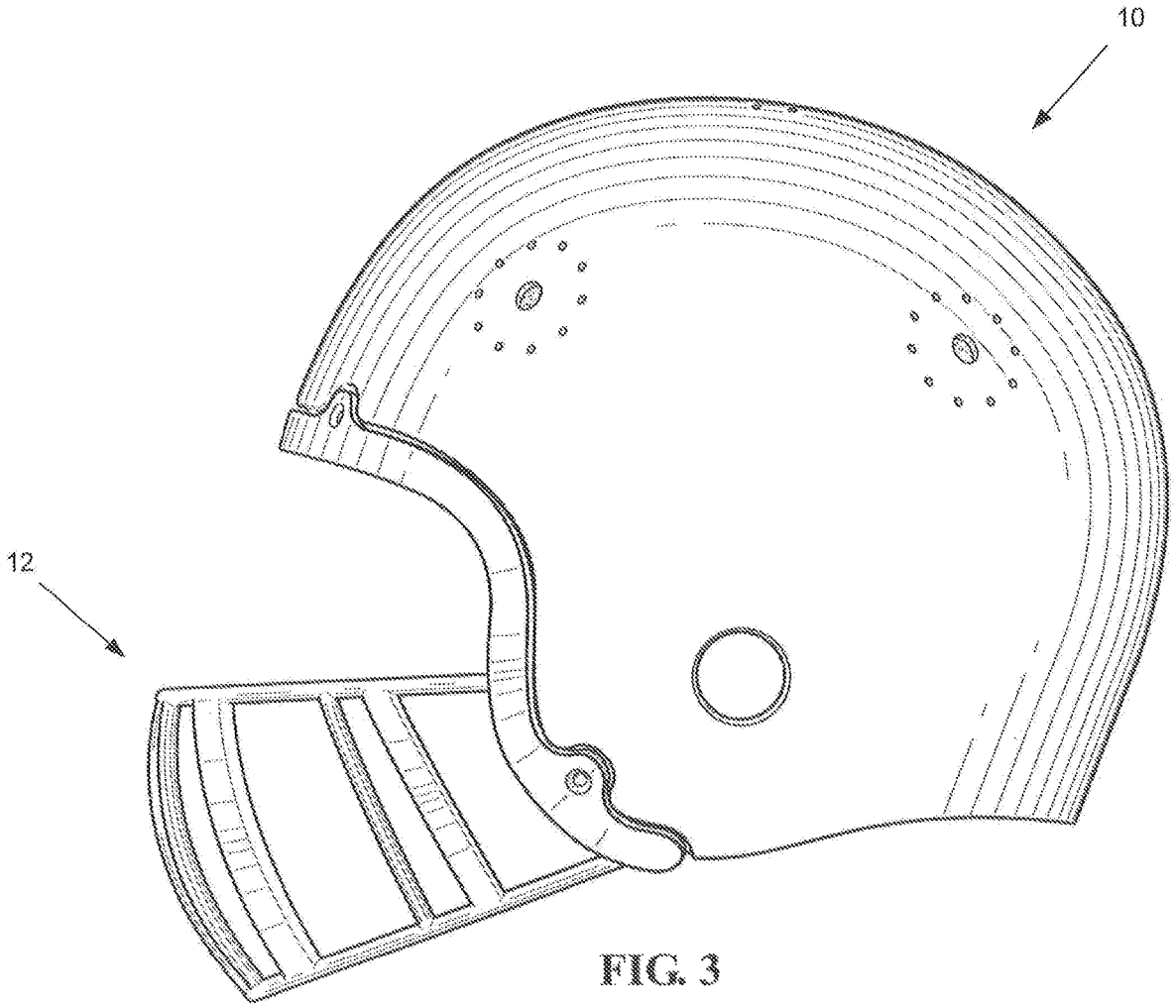
FIG. 3 is a left side view thereof.
Figure 4:
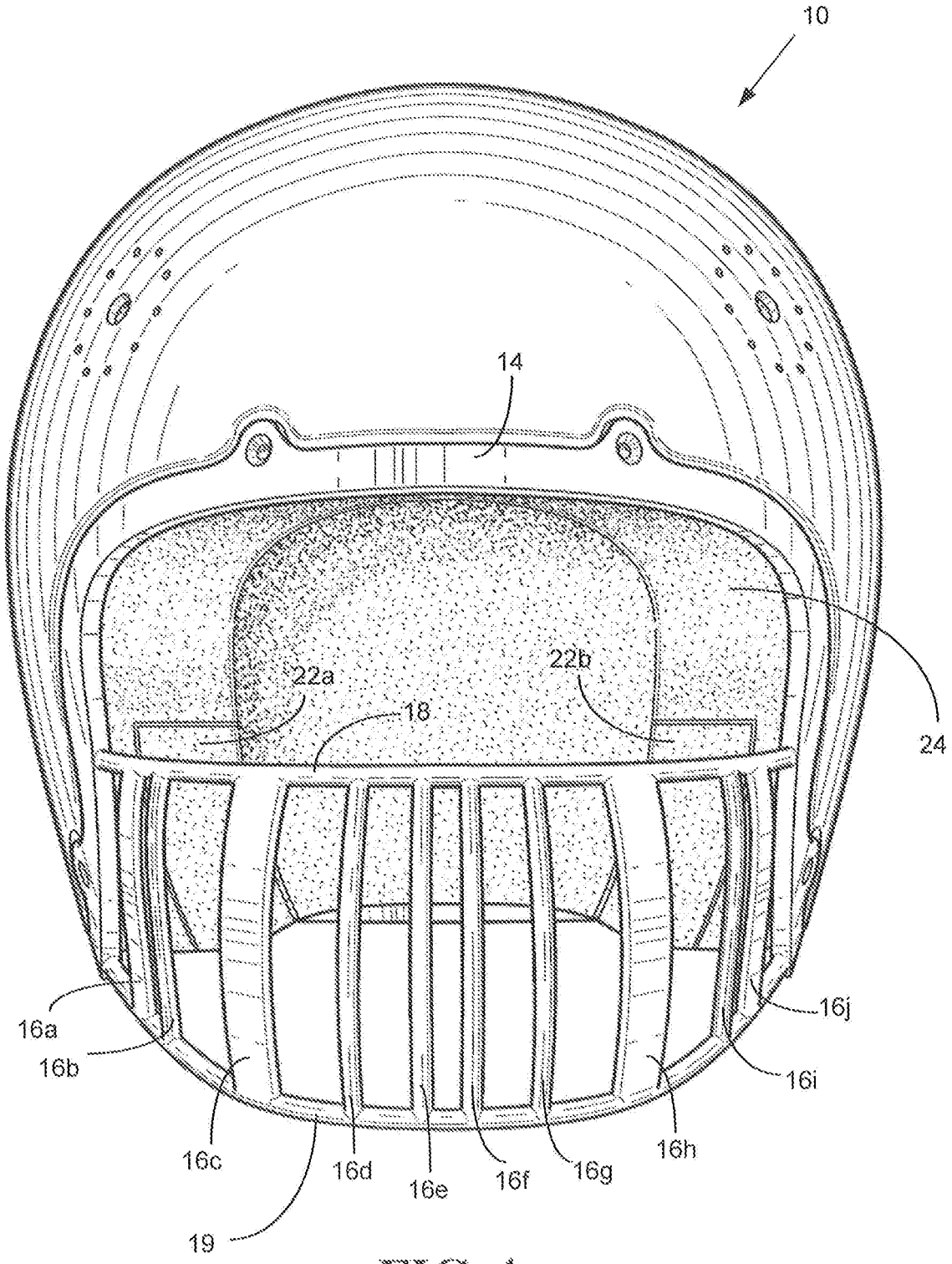
FIG. 4 is a front view thereof.
Figure 5:
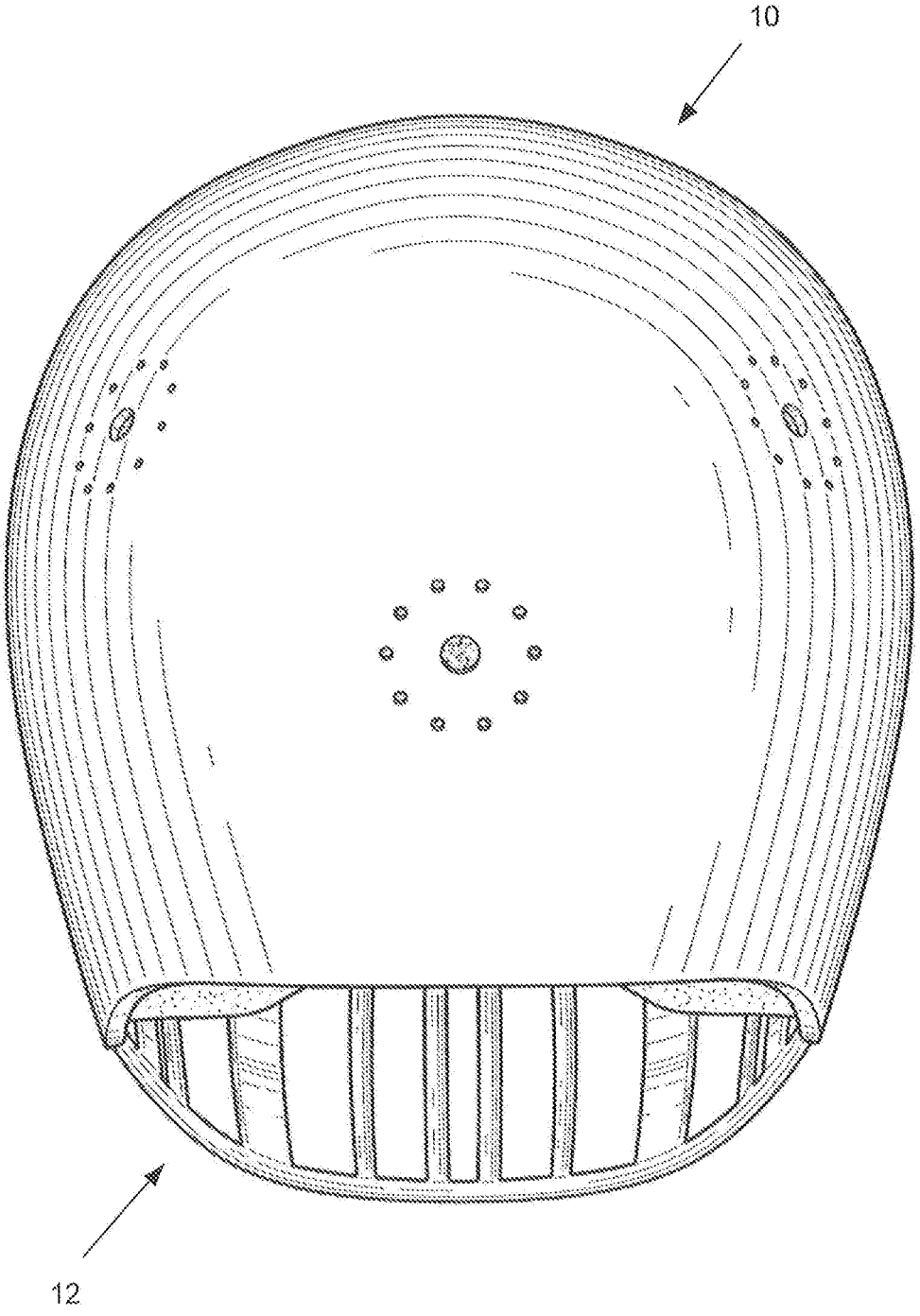
FIG. 5 is a back view thereof.

FIG. 1 shows a liner 24 within the helmet shell 15. The liner 24 is made of an open cell or closed cell foam, for example, in which the dense material is a polymeric thermoset or thermoplastic. Liner 24 should also be a functionally-graded material with different densities or different levels of porosity. The highest porosity will be nearest the innermost part adjacent to the head with a decreasing amount of porosity spatially changing towards the helmet shell 15.

FIG. 1 also shows two removable liner parts 22*a* and 22*b*, which comprise the same polymer type, geometric dimensions, and gradient of porosity as its adjacent material in the liner 24. The removable liners 22*a* and 22*b* can be pulled out while the helmet is still on an individual's head. This will allow better and easier removal of the total helmet if it is warranted.

Numerical values may be expressed herein in a range format. Such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" may include traditional rounding according to significant figures of the numerical value.

The above-described embodiments of the present disclosure are merely examples of implementations to set forth for a clear understanding of the principles of the disclosure. Many variations and modifications may be made to the above-described embodiments without departing substantially from the spirit and principles of the disclosure. All such modifications and variations are intended to be included herein within the scope of this disclosure. Disjunctive language used herein, such as the phrase "at least one of X, Y, or Z," unless specifically stated otherwise, is used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Moreover, all parameters presented herein including, but not limited to, sizes, dimensions, amounts, ratios, weights, and/or percentages, for example, represent approximate values. References to 'a' or 'an' concerning any particular item, component, material, or product is defined as at least one and could be more than one.

It should be emphasized that the above-described embodiments of the present invention are merely possible non-limiting examples of implementations, merely set forth for a clear understanding of the principles of the invention. Many variations and modifications may be made to the above-described embodiments of the present disclosure without departing substantially from the spirit and principles of the present invention. All such modifications and variations are intended to be included herein within the scope of this disclosure.

At least the following is claimed:

1. A helmet, comprising:

a housing sized for use on a human head and having an opening designed to expose a face associated with the human head; and a facemask attached to the housing and situated over the opening to cover the face, the facemask having a slightly curved front portion, a slightly curved right side portion, and a slightly curved left side portion, the facemask having a plurality of substantially only vertically oriented bars having different widths;

wherein the vertically oriented bars include a first type bar having a first width, a second type bar having a second width that is larger than the first width, and a third type bar having a third width that is larger than the first and second widths;

wherein the left and right side portions of the facemask include the first type bar and the second type bar, the second type bar being situated nearer to the housing than the first type bar;

wherein the front portion of the facemask includes four first type bars, two on a left side of the front portion and two on a right side of the front portion; and wherein a single third type bar is situated in a right side transitional region between the front portion and the right side portion of the facemask and in a left side transitional region between the front portion and the left side portion.

2. The helmet of claim 1, wherein the first type vertical bar has a substantially circular cross sectional area throughout its substantial length and wherein the second and third type vertical bars have substantially rectangular cross sectional areas throughout their substantial lengths.

3. A facemask for a helmet, comprising:

a slightly curved front portion, a slightly curved right side portion, and a slightly curved left side portion, the facemask having a plurality of substantially only vertically oriented bars having different widths;

wherein the vertically oriented bars include a first type bar having a first width, a second type bar having a second width that is larger than the first width, and a third type bar having a third width that is larger than the first and second widths;

wherein the left and right side portions of the facemask include the first type bar and the second bar, the second type bar being situated nearer to the housing than the first type bar;

wherein the front portion of the facemask includes four first type bars, two on a left side of the front portion and two on a right side of the front portion; and wherein a single third type bar is situated in a right side transitional region between the front portion and the right side portion of the facemask and in a left side transitional region between the front portion and the left side portion.

4. The facemask of claim 3, wherein the first type vertical bar has a substantially circular cross sectional area throughout its substantial length and wherein the second and third type vertical bars have substantially rectangular cross sectional areas throughout their substantial lengths.

5. The facemask of claim 3, wherein the width of the first type vertical bar is approximately 6 millimeters (mm), the width of the second type vertical bar is approximately 12 mm, and the width of the third type vertical bar is approximately 18 mm.

6. The facemask of claim 4, wherein the depth dimension in a direction between an outside and inside of the facemask of each of the first, second, and third type vertical bars is approximately 6 mm.

* * * * *